US006125597A

United States Patent [19]

Hoffman et al.

[11] Patent Number: 6,125,597

[45] Date of Patent: Oct. 3, 2000

[54] CONCRETE SKIRTING FOR MANUFACTURED HOMES

[76] Inventors: Keith M. Hoffman, 801 Delaware Ave., Ames, Iowa 50014; Bradley G. Hoffman, 8501 Ridgemont Dr., Urbandale, Iowa 50322; Rikel M. Hoffman, 621 Douglas Ave., Ames, Iowa 50010; Eric F. Horlyk, 1200 35th St. Suite 102, West Des Moines, Iowa 50266

[21] Appl. No.: 08/976,627

[22] Filed: Nov. 24, 1997

Related U.S. Application Data

[60] Provisional application No. 60/037,851, Feb. 7, 1997.

[51] Int. Cl.[7] ..... B60R 27/00

[52] U.S. Cl. ..... 52/169.12; 52/293.1; 52/293.3; 52/DIG. 3

[58] Field of Search ..... 52/294, 293.3, 52/293.1, 264, 169.5, 169.12, 269.11, DIG. 3, DIG. 11

[56] References Cited

U.S. PATENT DOCUMENTS

| | | | |
|---|---|---|---|
| 3,561,175 | 2/1971 | Best et al. | 52/294 X |
| 3,608,928 | 9/1971 | Hooker | 52/DIG. 3 X |
| 3,956,859 | 5/1976 | Ingestrom | 52/294 X |
| 4,145,861 | 3/1979 | Yarnick | 52/294 X |
| 4,214,412 | 7/1980 | Barylski | 52/169.12 |
| 4,290,246 | 9/1981 | Hilsey | 52/293.1 X |
| 4,335,548 | 6/1982 | Rehbein | 52/169.11 |
| 4,549,378 | 10/1985 | Ayers et al. | 52/169.12 |
| 4,656,797 | 4/1987 | Marquart | 52/DIG. 3 X |
| 4,694,625 | 9/1987 | Gregory | 52/294 |
| 4,738,061 | 4/1988 | Herndon | 52/DIG. 3 X |
| 5,193,714 | 3/1993 | Carey | 220/592 |
| 5,359,816 | 11/1994 | Iacouides | 52/293.3 X |
| 5,367,845 | 11/1994 | Hartling | 52/294 X |
| 5,511,350 | 4/1996 | Nivens | 52/293.3 |
| 5,535,556 | 7/1996 | Hughes, Jr. | 52/293.3 X |
| 5,704,172 | 1/1998 | Gougeon et al. | 52/169.11 |

*Primary Examiner*—Beth A. Stephan
*Assistant Examiner*—Brian E. Glessner
*Attorney, Agent, or Firm*—Henderson & Sturm LLP

[57] ABSTRACT

A skirting system for manufactured residential and commercial building structures. The skirting system having a plurality of precast concrete panels which are disposed around the base perimeter of the manufactured building. The top end of the panels are restrained between two vertically disposed members extending around the perimeter of the manufactured building. The bottom end of the panels rest on and are restrained by a plurality of set blocks. The set blocks are held in position by anchor rods inserted through apertures in the set block and into the soil. The edges of the panels are sealed with a bead of caulking. Soil is then placed against the exterior of the panels to assist in restraining the panels and to give the appearance of a cast-in-place concrete foundation wall. The precast panels may include a layer of foam insulation and the panels may also include an opening for receiving an automatic vent. Rather than using set blocks, the bottom of the panels may rest on a frost footing or concrete slab.

12 Claims, 9 Drawing Sheets

CONCRETE SKIRTING FOR MANUFACTURED HOMES

CROSS REFERENCE TO RELATED APPLICATIONS

This application contains disclosure from and claims the benefit under Title 35, United States Code, §119(e) of the following U.S. Provisional Application: U.S. Provisional Application Ser. No. 60/037,851 filed Feb. 7, 1997, entitled INSULCRETE CONCRETE SKIRTING.

BACKGROUND OF THE INVENTION

1. Field of the Invention

The present invention relates to manufactured residential and commercial buildings, and more particularly, to a skirting system for such residential and commercial buildings that encloses the air space between the manufactured building and a ground surface.

2. Description of the Related Art

Modular manufactured residential and commercial buildings have become increasingly popular in recent years. As the cost of new construction continues to rise, the relatively lower cost of modular manufactured residential or commercial buildings are attractive to many buyers. Over the past many years, much has changed in the design of modular manufactured residential and commercial buildings. Whereas manufactured buildings were essentially limited to the mobile-home or trailer-house type of structures, now, more traditionally-styled modular manufactured buildings having large structural elements are available and in use. Throughout this specification, reference is often made to "modular" or "manufactured" buildings, structures or homes. It should be appreciated that such references are intended to include both the "trailer-house" type structures on wheels, and the more permanent "traditionally styled" manufactured buildings, structures or homes where the modular sections are trucked to the building site on flatbed trailers.

Manufactured buildings are typically mounted on a foundation support system. Skirting, spanning between the manufactured building's rim joist and the ground surface, is used to hide the foundation support system and provide a more aesthetic appearance. Unfortunately, previous types of skirting systems suffer from several common problems. The first is that the skirting is typically made of aluminum, steel, or vinyl. The skirting therefore often becomes scratched or dented, detracting from the appearance of the building. Furthermore, most manufactured building owners want their buildings to look more like "site-built" homes. A building with an aluminum, steel or vinyl skirting is an obvious indication that the building is a manufactured home. As such, there is a need in the industry for a more aesthetically pleasing skirting that resembles the concrete foundation of site built homes.

Another problem with previous skirting systems is that they require a significant amount or repair and maintenance. For example, it is difficult to maintain a tight fit with vinyl skirting; therefore, during periods of high wind it is common for the vinyl panels to become dislodged and blow away. Vinyl skirting is also problematic in that it is easily marred and scratched when struck by another object. Further, after years of exposure to sunlight and ultra violet radiation, the vinyl skirts discolor and lose their structural integrity. Accordingly, there is a need in the art for improved skirting for manufacturing homes that does not require significant repair or maintenance, maintains its structural integrity, and does not change over time in aesthetic appeal.

It is also difficult to back fill soil against the previously described skirting around the base perimeter of manufactured homes. It is the ability to back fill dirt and soil against the skirting that helps to give the appearance of a site built home. However, aluminum, steel or vinyl skirting does not have the structural integrity to withstand significant lateral loads. As such, there is also a need in the art for improved skirting for manufactured homes that can support back fill around the base perimeter of the manufactured home.

Another problem associated with the previous skirting systems is the inability to provide good ventilation for the space between the manufactured home and the ground surface. Prior art ventilation systems merely consist of louvered vents in the skirting. It is desirable to have a ventilation system that can be opened in the hot summer months and closed during cold winter months. During the winter months when temperatures generally decrease, ventilation becomes less important and the ability of the skirting to insulate the base of the manufactured home becomes more important. Thus, there is also a need in the art for an improved ventilation system for use with manufactured homes that can be adjusted based upon the outside ambient temperature.

It can therefore be seen that there is a real and continuing need for the development of an improved skirting assembly for manufactured residential and commercial building structures.

BRIEF SUMMARY OF THE INVENTION

The present invention discloses a skirting system for manufactured residential and commercial building structures. The skirting system is comprised of a plurality of concrete panels which are disposed around the base perimeter of the manufactured building. In the preferred embodiment, the top end of the panels are restrained by a prefabricated receiving channel secured to the rim joist of the manufactured building. The bottom end of the panels rest on and are restrained by a plurality of set blocks. The set blocks are held in position by anchor rods inserted through apertures in the set block and into the soil. The edges of the panels are sealed with a bead of caulking. Soil is then placed against the exterior of the panels to assist in restraining the panels and to give the appearance of a cast-in-place concrete foundation wall.

In an alternate embodiment, rather than caulking the edges of the panels together, an H-strip is used to connect the panels together.

In another alternative embodiment, rather than using prefabricated channels to restrain the top of the panels, the tops of the concrete panels may be restrained between wood panels attached to the rim joist of the manufactured building and exterior wood sheeting members. The exterior wood sheeting member is spaced away from the sheeting the thickness of the concrete panel.

In yet another alternate embodiment, rather than using set blocks to support and restrain the bottom of the concrete panels, a grade beam set below frost depth may be used.

The skirting may also include an automatic vent mounted in an opening of the concrete panel. The vent opens and closes based upon the outside ambient temperature.

Foam insulation may be attached to the interior sides of the concrete panels to increase the R-value of the concrete panels. Increasing the R-value of the panels reduces the heat exchange between the ambient outside air and the area inside the concrete skirting.

An objective of the present invention is the provision of an improved skirting assembly for manufactured homes and the like.

Another objective of the present invention is the provision of a skirting assembly that is aesthetically pleasing and does not subtract from the aesthetic appeal of the manufactured home.

Another objective of the present invention is the provision of a skirting assembly that does not require significant repair or maintenance.

Still another objective of the present invention is the provision of a skirting assembly that does not lose its aesthetic appeal after a period of use and exposure to the elements.

Another objective of the present invention is the provision of a rigid skirting assembly that allows for the easy back fill of soil against it.

Still another objective of the present invention is the provision of a skirting assembly that provides good ventilation to the space beneath the manufactured home.

Another objective of the present invention is the provision of a skirting assembly that is efficient in operation, economical to manufacture, and durable in use.

These and other features, objectives, and advantages will become apparent to those skilled in the art with reference to the accompanying specification.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
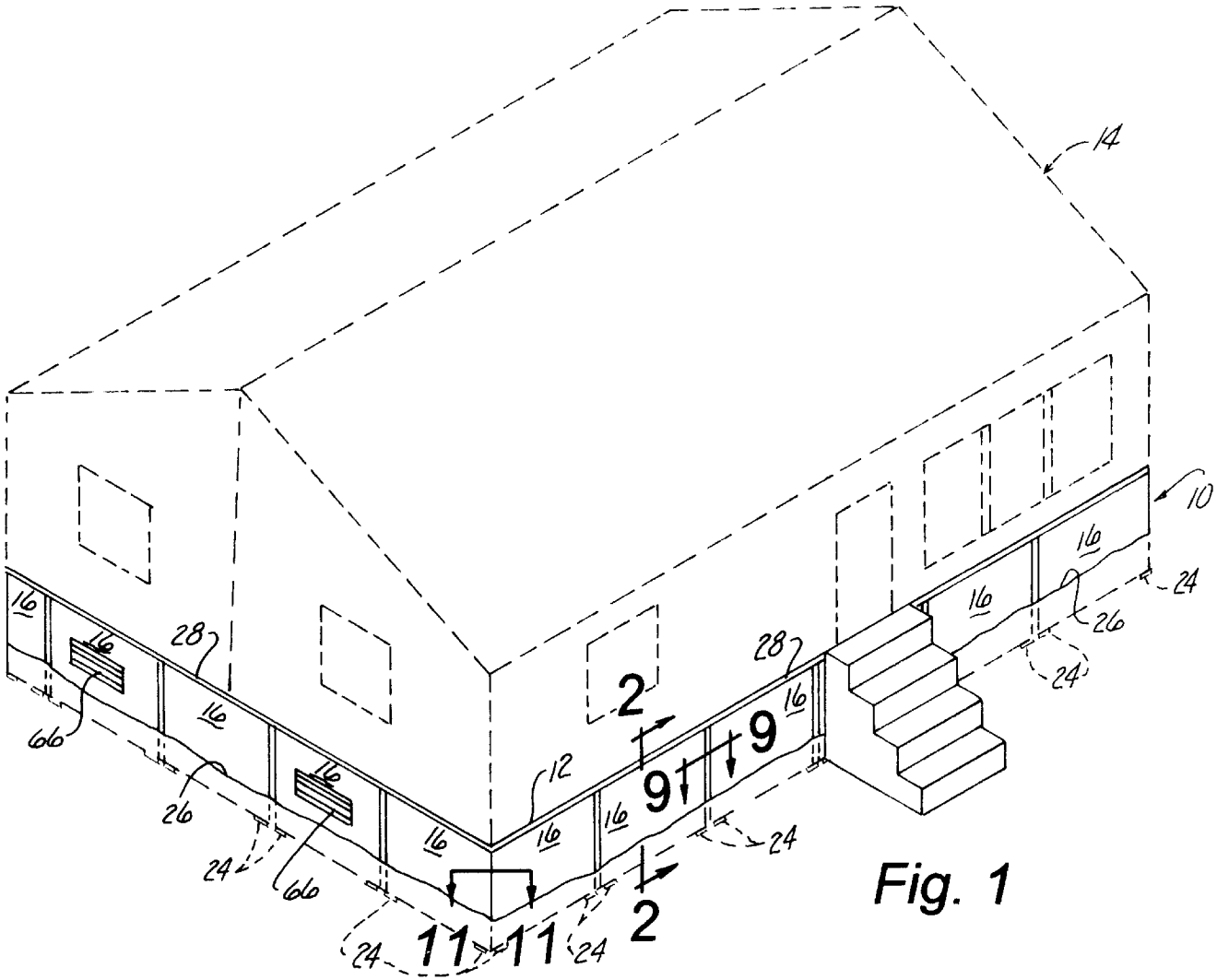
FIG. 1 is a perspective view of a manufactured home using the concrete skirting system of the present invention.

Referring now to the drawings, wherein like reference numerals designate identical or corresponding parts throughout the several views, FIG. 1 shows the skirting system of the present invention depicted generally at (10) installed around the base perimeter (12) of a manufactured building structure (14). The skirting system (10) is comprised of a plurality of rectangular precast concrete panels (16) vertically arranged to enclose the area between the base perimeter (12) of the manufactured building (14) and the ground surface (18) (FIG. 2).

Figure 5:
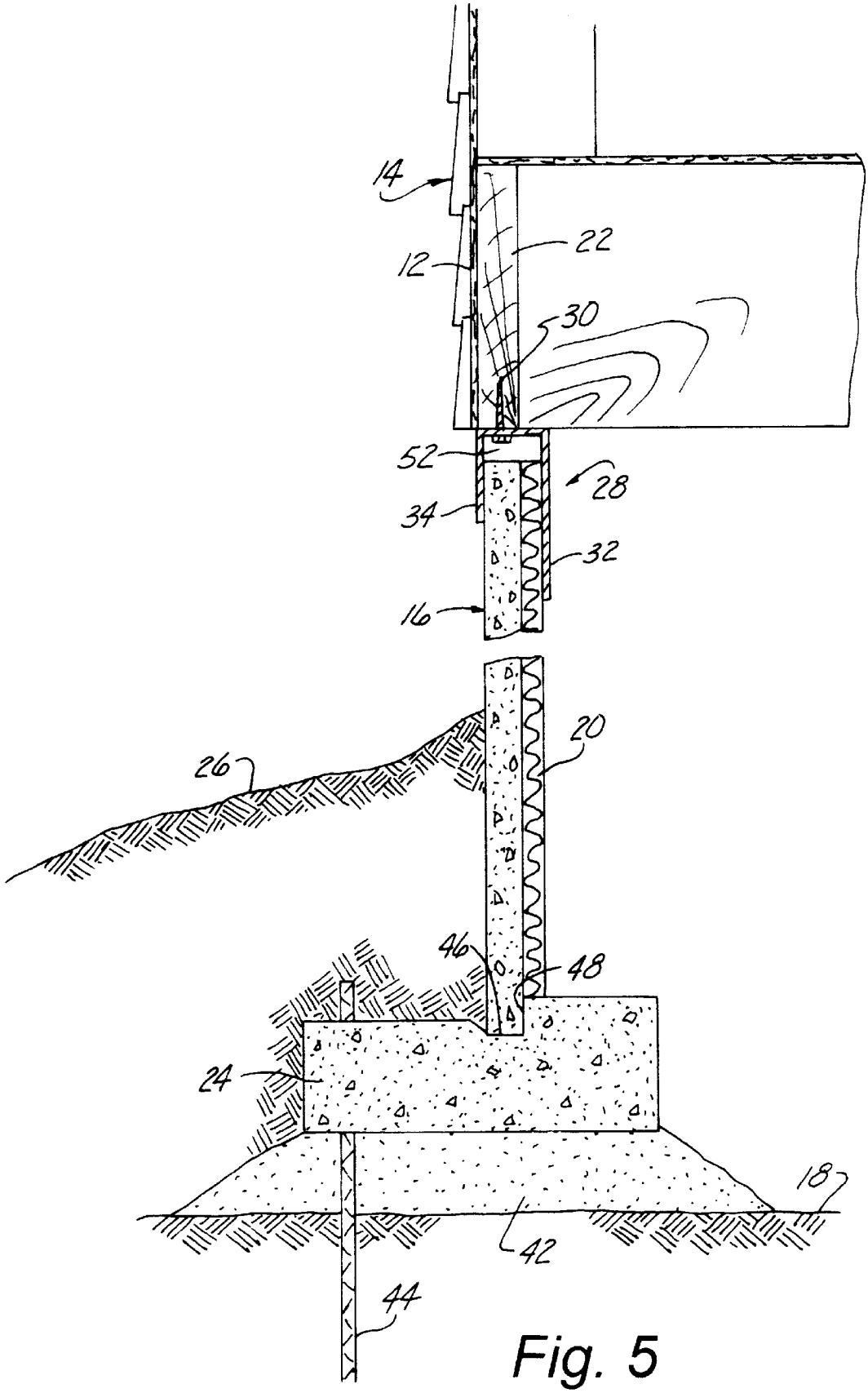
FIG. 5 is a cross-sectional view of a typical concrete skirting panel as shown in FIG. 2 with foam insulation secured to its inside face.

The concrete panels (16) are preferably 1¼ inches thick, and are four feet long by three feet high. The panels are preferably constructed of light weight concrete and include fiber reinforcing. Welded wire fabric reinforcing may be used as an alternative to fiber reinforcing. Foam insulation (20) may be attached to the inside face of the concrete panels (16) for added R-value as shown in FIG. 5.

Figure 2:
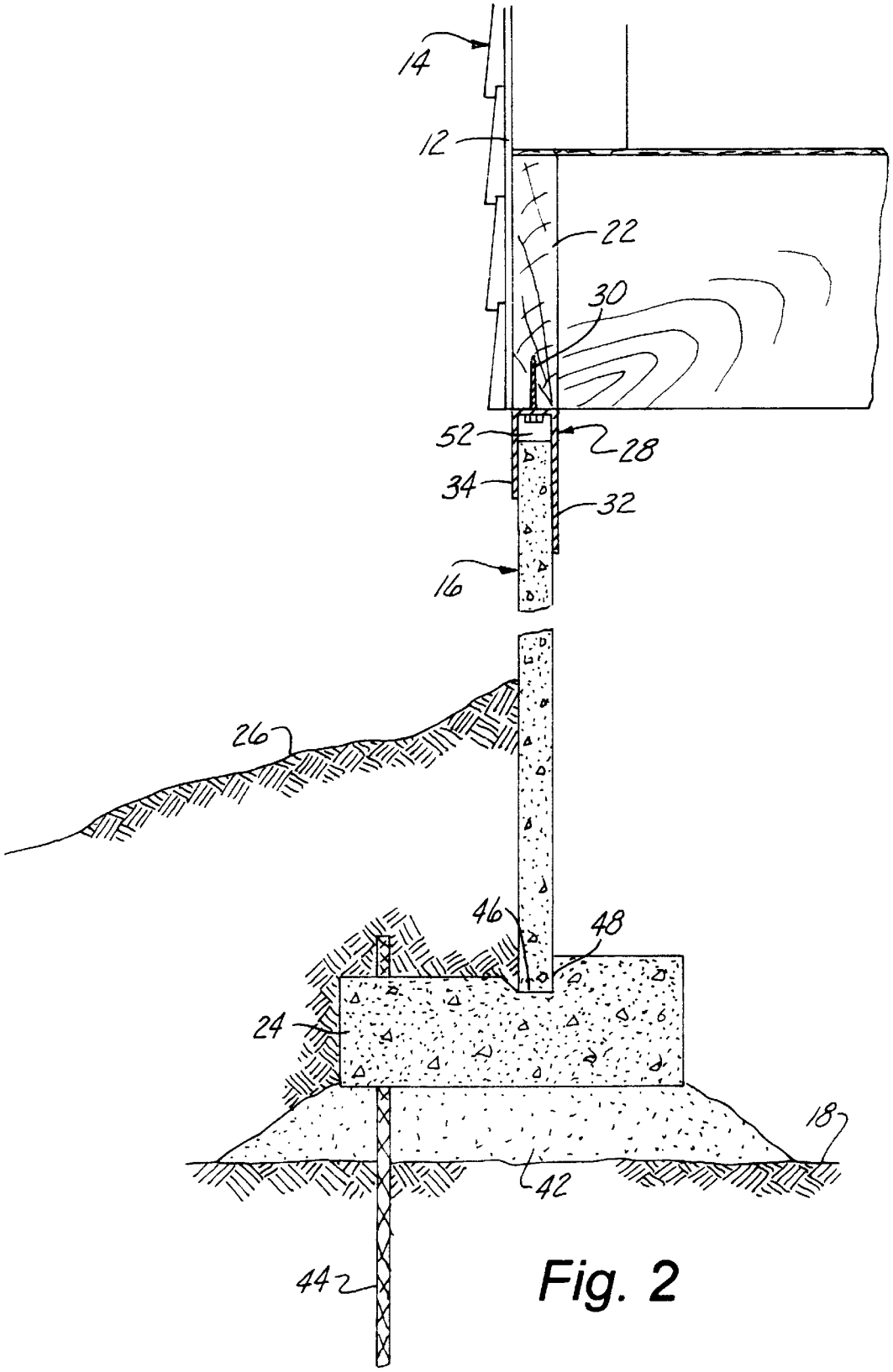
FIG. 2 is a cross-sectional view of the preferred embodiment of the skirting system taken along lines 2—2 of FIG. 1.

In the preferred embodiment, illustrated in FIG. 2, each of the concrete panels (16) is disposed between the rim joist (22) at the base perimeter (12) of the manufactured building (14) and a set block (24). Backfill (26) is placed around the exterior periphery of the panels (16) and sloped away from the building (14) which gives the skirting (10) the appearance of a cast-in-place concrete foundation of a site built structure. The top of the panels (16) are restrained within top guide channels (28) which are secured by screws (30) to the bottom of the rim joist (22) of the structure (14).

Figure 6:
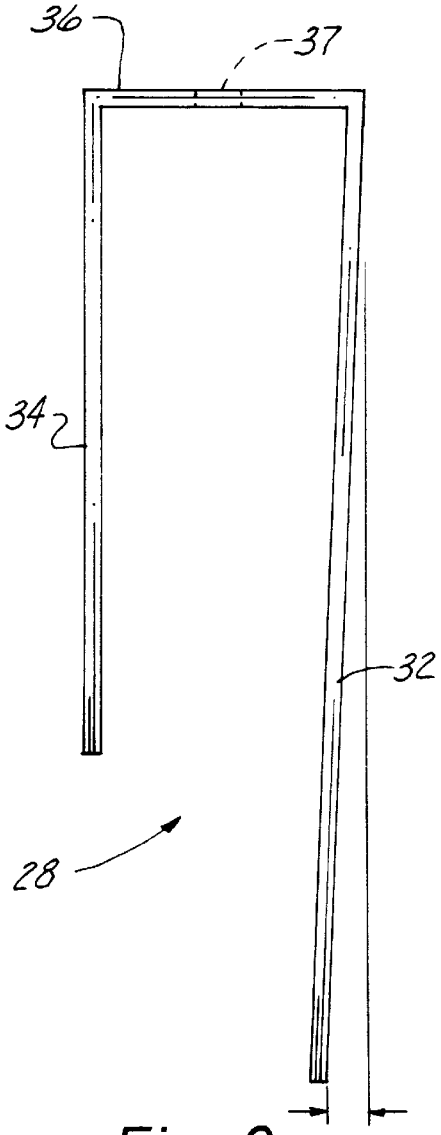
FIG. 6 is a detail view of the top channel member.

The top guide channels (28), best viewed in FIG. 6, are preferably fabricated from ten foot long, galvanized, eighteen gauge steel plate and bent as shown to include a longer six inch interior leg (32) and a shorter four inch exterior leg (34) and a 1½ inch deep interconnecting web (36) (the purpose in the different leg lengths which will be discussed later). Alternatively, the guide channel (28) may be constructed from extruded plastic. It should be appreciated that if a layer of foam insulation (20) (FIG. 5) is secured to the panel (16), a deeper web (36) for the top guide channel member (28) will be required so that the 1¼ inch panel (16) and insulating foam layer (20) will fit into the top guide panel as shown in FIG. 5. Also as seen in FIG. 6, the longer interior leg (32) is preferably canted inward ¼ inch toward the shorter exterior leg (34). This canted leg (32) acts as a bias against the panel (16) preventing the panel (16) from wobbling back and forth within the top guide channel (28) when the panel (16) is installed therein. The web (36) includes holes (37) spaced along its length at twelve inch centers for receiving the attaching screws (30)

Figure 3:
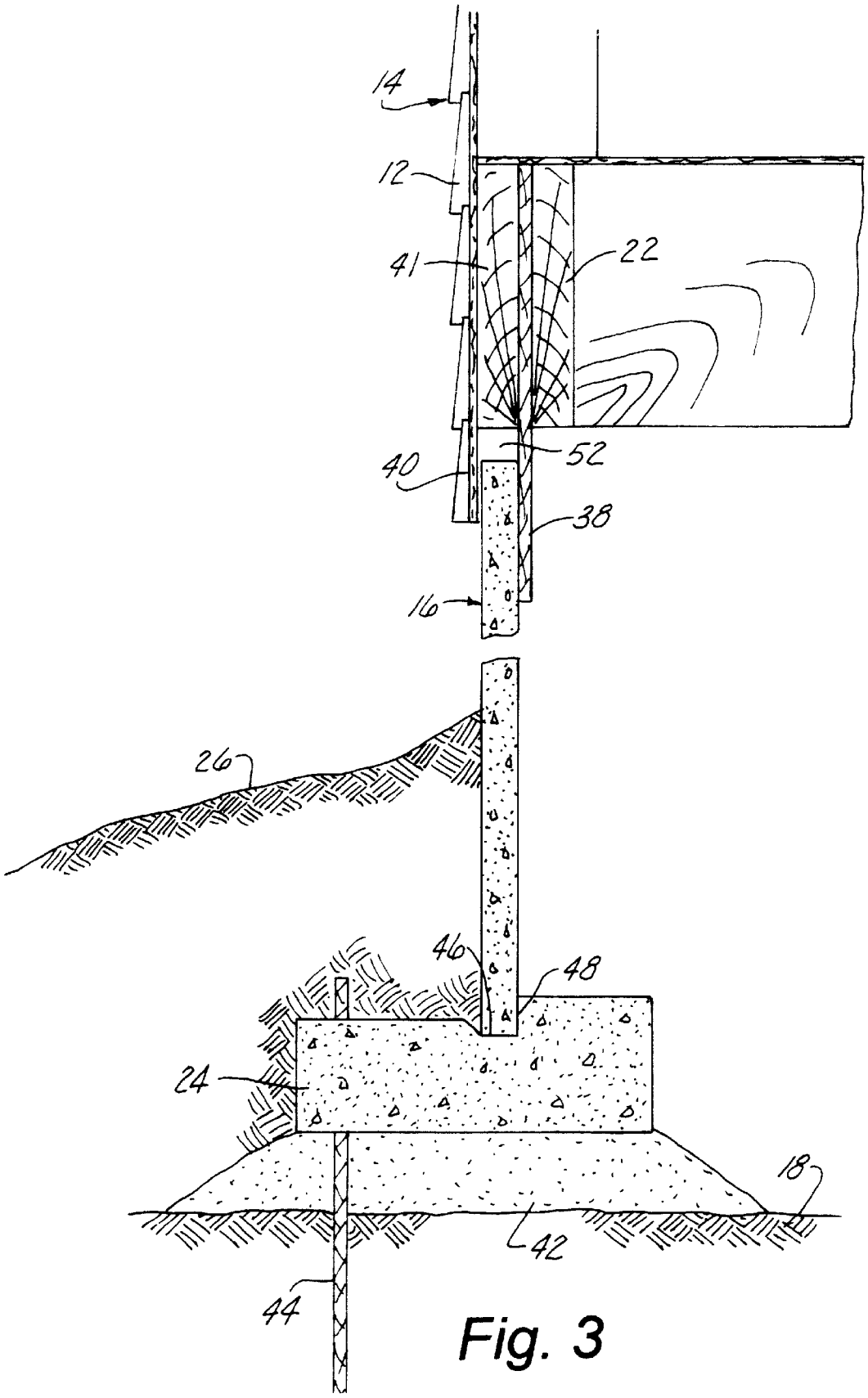
FIG. 3 is a cross sectional view of an alternative embodiment of the skirting system shown in FIG. 2.

In an alternate embodiment, as shown in FIG. 3, the top of the concrete panel (16) may be disposed between interior and exterior wood sheeting members (38 and 40). In this embodiment, an interior wood sheeting member (38) is secured to the rim joist (22). A second rim joist (41) is secured adjacent the interior wood sheeting member (38) and acts as a spacer for the panel (16). The interior and exterior sheeting members (38 and 40) act to restrain the top of the panel (16) therebetween.

Figure 7:
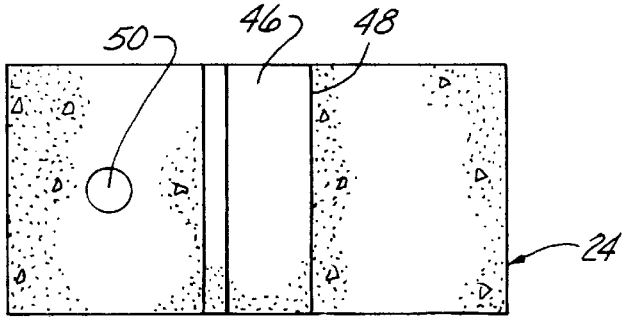
FIG. 7 is a top plan view of the set block.
Figure 8:
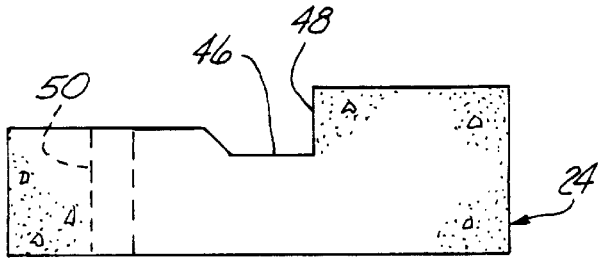
FIG. 8 is a side elevation view of the set block.

Referring back to the preferred embodiment of FIG. 2, it can be seen that the panel (16) is supported on the ground surface (18) by set blocks (24). The set blocks (24) are preferably placed on a layer of packed sand or gravel (42). The set blocks (24) are anchored to the soil (18) by an anchor rod (44) such as a #5 rebar. As best viewed in FIGS. 7 and 8, the set block (24) is preferably a twelve inch long by six inch wide precast concrete block. The set block (24) further includes a notch (46) for receiving the bottom edge of the concrete panel (16). The raised ledge (48) acts to restrain the panel (16) from lateral movement when backfill (26) is placed against the exterior surface of the panel (16). The set block (24) includes an aperture (50) for receiving the #5 rebar anchor (44). It should be appreciated that the set block (24) may rest directly on top of the finished soil grade (18) or it may rest in a shallow excavation as shown in FIG. 2. When backfill (26) is placed against the panel (16), the set block (24) is hidden from site. It should also be appreciated that the set block (24) is set at an elevation wherein the top of the panel (16) remains one or two inches below the rim joist (22) thereby creating a space (52) for vertical movement of the panel (16) which may result from temperature changes and possible soil heave.

Figure 4:
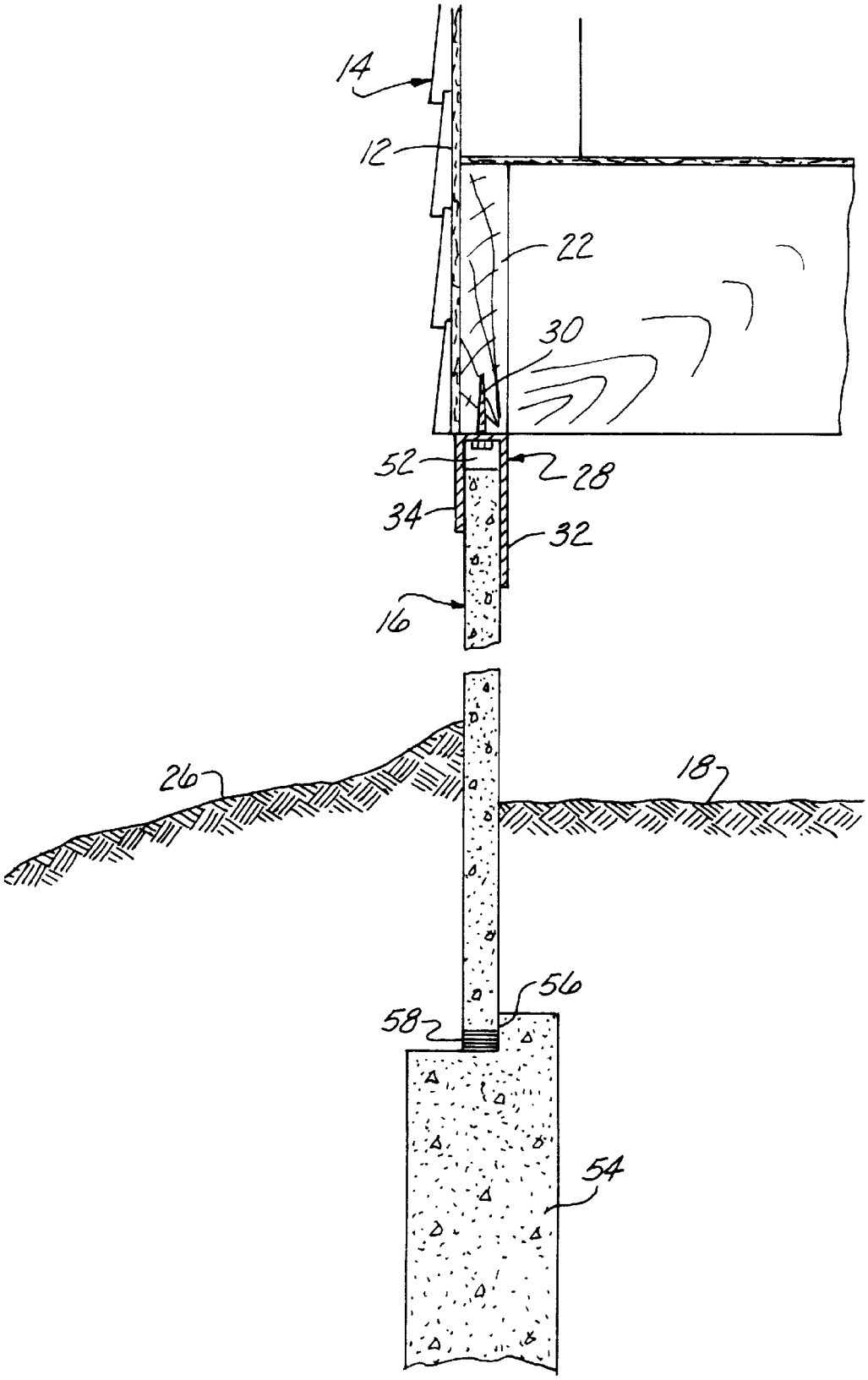
FIG. 4 is a cross sectional view of another alternative embodiment of the skirting system shown in FIG. 2.

In an alternate embodiment, shown in FIG. 4, a cast-in-place frost footing (54) replaces the set block supports (24). The frost footing (54) bears below frost depth of the soil and may be six to eight inches in width. By utilizing a frost footing (54), the concern over vertical movement of the panel (16) due to soil heave is eliminated. Similar to the set blocks (24), a raised ledge (56) is incorporated into the top of the frost footing (54) to resist lateral movement of the panel (16) when backfill (26) is placed against the exterior surface of the panel (16). Shims (58) may be utilized to level and raise the panel (16) to its final desired elevation. Non-shrink grout may also be placed under and behind the panel to secure it to the frost footing (54).

Figure 9:
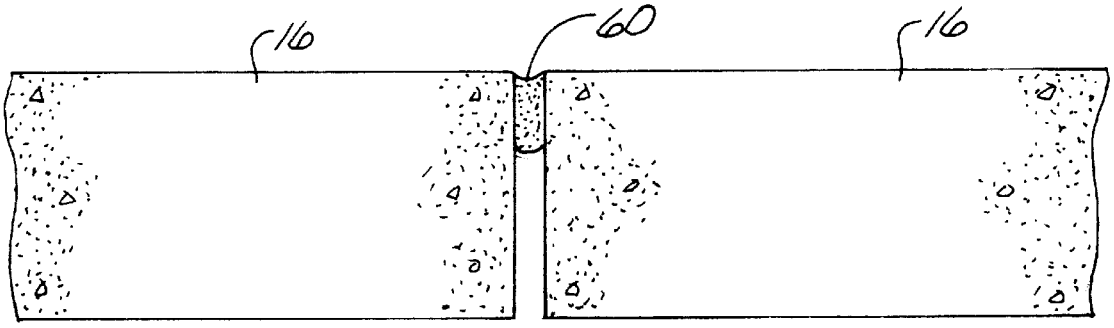
FIG. 9 is a cross sectional view of the skirting system taken along lines 9—9 of FIG. 1 showing the preferred vertical joint connection.
Figure 10:
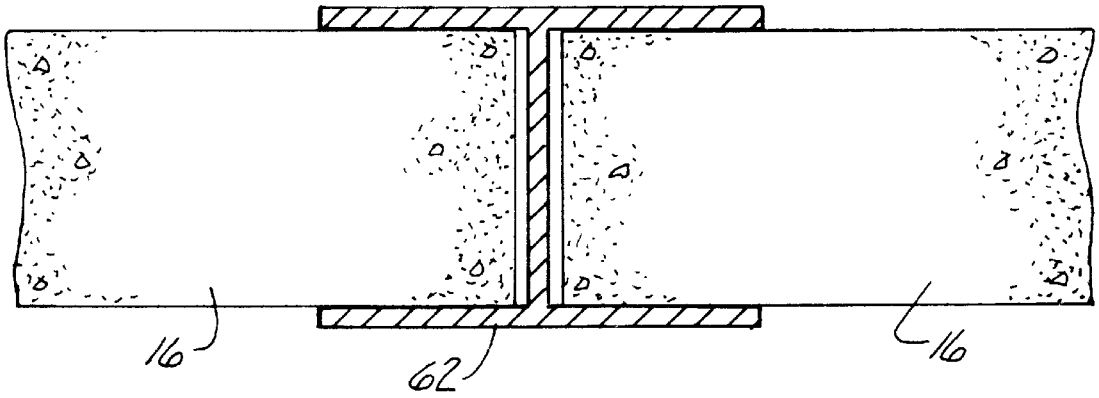
FIG. 10 is a cross sectional view of an alternative embodiment of the vertical joint connection for the skirting system shown in FIG. 9.

The vertical joints between adjacent panels (16) are preferably sealed with a bead of caulk (60) as shown in FIG. 9, which is a cross sectional view of two adjacent panels (16) taken along lines 9—9 of FIG. 1. As an alternative to caulking the vertical joints between adjacent panels (16), an H-shaped member (62) as shown in FIG. 10 may be used. The H-shaped member (62) may be galvanized extruded metal or plastic or any other semi-rigid material.

Figure 11:
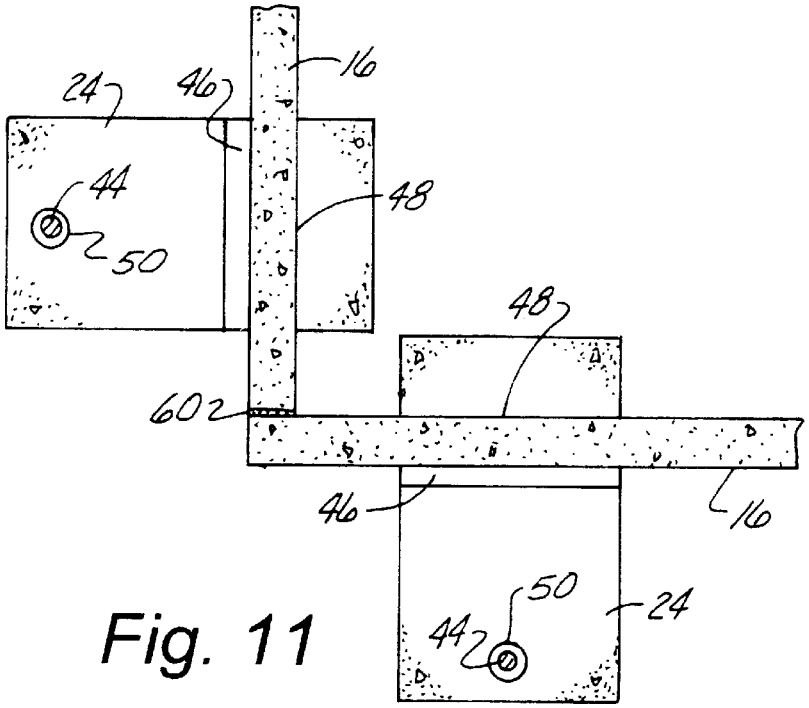
FIG. 11 is a cross-sectional view of the skirting system taken along lines 11—11 of FIG. 1 showing a typical corner assembly.
Figure 12:
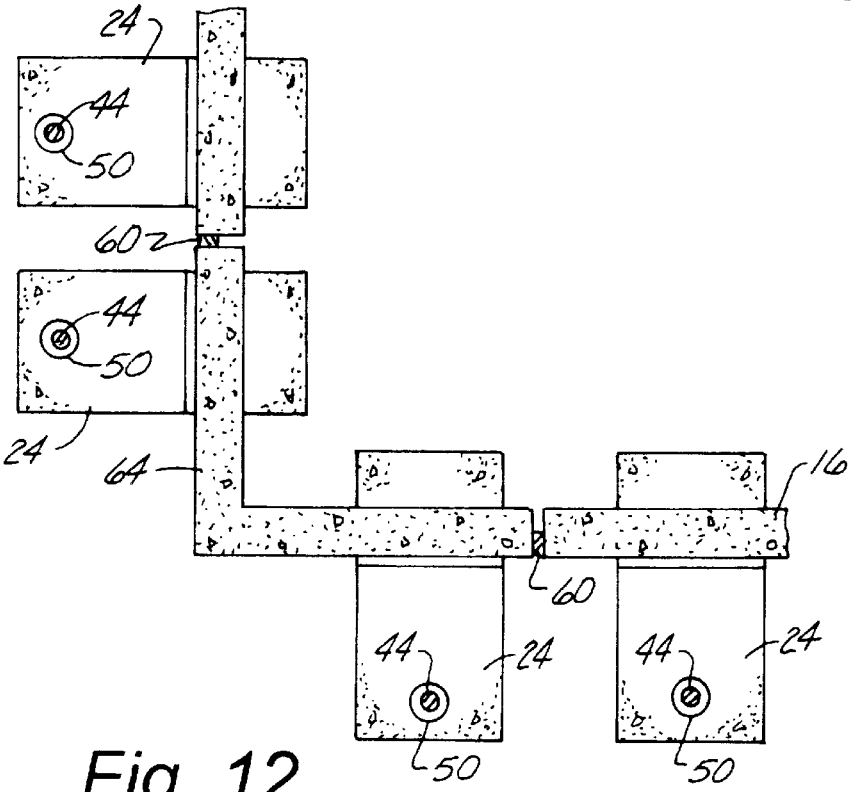
FIG. 12 is an alternate embodiment of the typical corner assembly of FIG. 11 showing the use of precast corner members.

FIG. 11, is a view taken along lines 11—11 of FIG. 1 showing a typical corner detail of two intersecting concrete panels (16). A bead of caulk (60) is placed between the abutting panels (16) similar to the other vertical joints between adjacent panels (16). As an alternative to the corner detail of FIG. 11, a prefabricated corner panel (64) as shown in FIG. 12 may be used so that an exposed edge of one of the panels (16) is not visible, thus giving a more finished appearance to the skirting (10). It should be understood that the prefabricated corner panels (64) may include both inside corner details or outside corner details.

As shown in FIG. 1, several of the concrete panels (16) preferably include an automatic louvered vent (66) which opens and closes based upon the outside ambient air temperature. The automatic vents (66) remain open during periods of warm temperature, and remain closed for insulation purposes during periods of colder weather. It is recommended that the vents (66) are placed no closer than four feet from the corners of the manufactured building (14). Openings for the vents (66) may be cut in the panels (16) on site or special panels (16) may be cast with vent openings in them.

Figure 13:
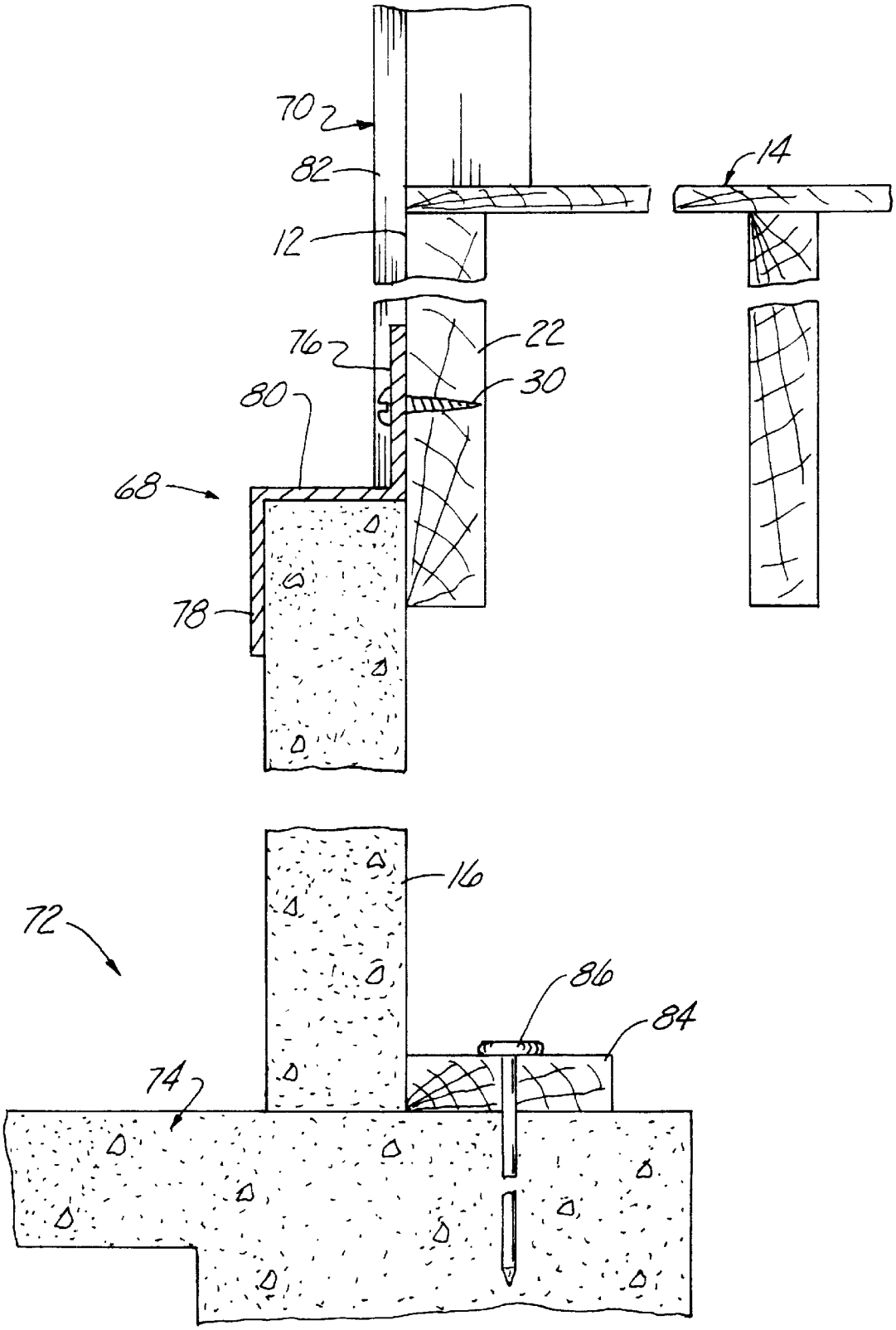
FIG. 13 is an alternative embodiment of the skirting assembly as installed in a garage application.

Referring now to FIG. 13, as an alternative to using the top channel guide (28), a Z-shaped top guide (68) may be used, and is recommended for interior applications where the space between the ground surface (18) and the ridge beam (22) is exposed. For example, where a manufactured home (14) has an attached garage. FIG. 13 shows such an application using the Z-shaped top guide (68) attached to the ridge beam (22) of an interior wall (70) of an attached garage (72). As can be seen, rather than using set blocks (24) or the alternative frost beam (54) embodiment for supporting the skirting panels (16), the panels (16) rest directly on the concrete slab (74) of the garage (72). The Z-strip includes a first leg (76), an oppositely disposed, substantially parallel, second leg (78), and an interconnecting web (80) therebetween. The first leg (76) preferably includes holes spaced along its length at twelve inch centers for receiving attaching screws (30) for securing the Z-shaped top guide (68) to the exposed rim joist (22) of the interior wall (70). The Z-shaped top guide (68) is positioned on the rim joist (22) so that at least one inch of the ridge beam (22) projects below the first leg (76). As can be seen from FIG. 13, the panel (16) is thereby restrained between the ridge beam (22) and the second leg (78) of the Z-shaped top guide (68). An added advantage to using the Z-shaped guide (68) in such applications, is that the web (80) of the Z-shaped guide (68) may act as a ledge for use during installation of sheet rock (82), or other wall covering for the garage wall (70). The bottom of the skirting panel (16) is preferably restrained from lateral movement by securing a stop (84) such as a 2×4 to the concrete slab (74) with concrete nails (86) or other types of anchors used for securing objects to concrete slabs. A bead of caulk may be used to seal the bottom of the panel (16) to the concrete slab (74).

In installing the concrete skirting (10) of the present invention, in the preferred embodiment illustrated in FIG. 2, the first step is to prepare the site by leveling the area where the manufactured building (14) is to be located. If the site slopes, it is recommended that the site be graded to level the area where the manufactured building (14) will sit. This will minimize the need for cutting panels (16) and hand excavation for the set blocks (24) (as discussed below). Once the manufactured home (14) is set upon the foundation support system (not shown), the distance between the rim joist (22) and the ground surface (18) is measured around the base perimeter (12) of the manufactured building (14). This will give the installation crew to plan for the height of the panels (16) required to complete the panel installation.

Next, the top guide channel (28) is installed on the rim joist (22) around the base perimeter of the building (14) using screws (30). It is important that the shorter leg (34) of the top guide channel (28) be installed to the exterior of the manufactured building (14) so that the panels (16) are easier to fit within the top guide channel (28) during panel installation.

Next, starting at an outside corner, the first set block (24) is located under the top channel guide (28) using a plumb bob. The set block (24) is then leveled and squared. A layer of sand or gravel (42) is preferably located under the set blocks (24) to make it easier to level the set blocks (24).

Next, one end of the first panel (16) is positioned in the slot (46) of the first set block (24). The top of the panel (16) is then lifted upward until it fits between the inside and outside legs (32 and 34) of the top guide channel (28). The second set block (24) is then slid into position under the bottom end of the panel (16), thus securing the panel (16) within the top guide channel (28). The panel (16) is then adjusted until it is plumb, square, and level. When the panel (16) is properly positioned, the set blocks (24) are anchored by pounding an anchor (44) into the soil through the aperture (50) in the set blocks (24). This process is continued until the entire base perimeter (12) of the building (14) is enclosed by panels (16). For special panel lengths or heights, the panels (16) may be saw cut by using a skill saw with an appropriate blade for cutting concrete.

It is recommended that an access panel (not shown) be installed on the back side of the manufactured building (14)

or at the location of the owner's choice, to provide access to the space beneath the manufactured building (14). Suggested locations for panels (16) with automatic vents mounted therein are at a minimum of four feet and from each corner.

After completing the installation of the concrete panels (16), the vertical joints between adjacent panels (16) are sealed with a bead of caulk (60) (see FIG. 9) or alternatively, the ends of adjacent panels (16) may be held together with the H-shaped member (62) (see FIG. 10). Any caulking should be tooled so that it is smooth.

Finally, backfill (26) is placed against the exterior surface of the panels (16). The backfill (26) should be placed by hand to a maximum height of approximately eighteen inches. The backfill (26) should not be placed by a machine and should not be machine compacted or the panels (16) may be damaged. Placing backfill (26) against the panels (16) hides the set blocks (24) from view and provides the owner with the appearance of a site built structure, by giving the skirting (10) the appearance of backfilled cast-in-place concrete foundation.

For the alternative embodiments of FIGS. 3 and 4 discussed above, the same basic procedures are performed in substantially the same way. Naturally, when using the embodiment of FIG. 4, the frost footing (54) eliminates the need for positioning and anchoring the set blocks (24).

Although only exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A skirting system in combination with a manufactured building having a base perimeter supported at an elevation above a ground elevation, said skirting system comprising:

a top guide channel extending around and secured to a bottom edge of a base perimeter of a manufactured building, said top guide channel comprising a first leg and a second longer leg spacedly separated a predetermined distance by a web at an upper end of said first and second legs;

a panel support disposed below the manufactured building base perimeter elevation, said panel support having a raised ledge on an upper surface thereof;

a plurality of precast concrete panels having an interior surface, an exterior surface, and a predetermined length and height and thickness, said plurality of precast concrete panels disposed in adjacent relation around the base perimeter of the manufactured building, a top edge of said panels received between said first and second legs of said top guide channel and a bottom edge of said panels supported on said upper surface of said panel support such that a lower interior surface of said precast concrete panels is at least partially abutting said raised ledge of said panel support such that said lower end of said precast concrete panel is laterally restrained by said raised ledge, and further wherein said precast concrete panel height is less than a distance from the manufactured building base perimeter bottom edge elevation to said upper surface of said panel support disposed therebelow but greater than a distance from a bottom edge of said first leg of said top guide channel to said upper surface of said panel support such that an upper edge of said precast concrete panels are laterally restrained between said first and second legs of said top guide channels but with a space between the manufactured building base perimeter bottom edge and said top edge of said panels, thereby enabling said panels to vertically displace due to temperature changes and possible soil heave.

2. The skirting system of claim 1 wherein said top guide channel is bent steel plate.

3. The skirting system of claim 1 wherein said top guide channel is an extruded shape.

4. The skirting system of claim 1 wherein said top guide channel comprises wood sheeting members and dimensional lumber to form the first and second legs and the web.

5. The skirting system of claim 1 wherein a lower end of said longer second leg of said top guide channel is canted toward said first leg such that said lower end of said canted longer second leg acts as a bias against said precast concrete panels disposed between said first and second legs to laterally restrain said upper end of said precast concrete panels therebetween.

6. The skirting system of claim 1 wherein said panel support comprises a plurality of set blocks, each of said set blocks having an aperture for receiving an anchor extending therethrough and into the ground surface to restrain said set blocks from lateral movement.

7. The skirting system of claim 1 wherein said panel support comprises a cast-in-place frost beam.

8. The skirting system of claim 1 wherein said panel support comprises a poured concrete slab.

9. The skirting system of claim 1, wherein said precast concrete panels include an opening for an automatic vent mountable therein.

10. The skirting system of claim 1 wherein joints between said vertically disposed adjacent precast concrete panels are sealed with caulk.

11. The skirting system of claim 1 wherein abutting ends of said adjacently disposed precast concrete panels are received by an H-shaped member.

12. The skirting system of claim 1 wherein said plurality of vertically arranged precast concrete panels include precast corner panels.

* * * * *